US005665249A

United States Patent [19]

Burke et al.

[11] Patent Number: 5,665,249

[45] Date of Patent: Sep. 9, 1997

[54] MICRO-ELECTROMECHANICAL DIE MODULE WITH PLANARIZED THICK FILM LAYER

[75] Inventors: Cathie J. Burke, Rochester; William G. Hawkins, Webster; Herman A. Hermanson, Penfield; Michael C. Ferringer, Ontario; Almon P. Fisher, Rochester; Diane Atkinson, Webster, all of N.Y.

[73] Assignee: Xerox Corporation, Stanford, Conn.

[21] Appl. No.: 330,146

[22] Filed: Oct. 17, 1994

[51] Int. Cl.[6] ..... B24B 1/00; B41J 2/04

[52] U.S. Cl. ..... 216/2; 216/27; 216/33; 216/88; 29/890.1; 347/65

[58] Field of Search ..... 216/2, 27, 33, 216/34, 88, 89; 29/890.1; 347/65; 156/153

[56] References Cited

U.S. PATENT DOCUMENTS

| | | | |
|---|---|---|---|
| Re. 32,572 | 1/1988 | Hawkins et al. | 156/626 |
| 4,638,337 | 1/1987 | Korpey et al. | 346/140 R |
| 4,678,529 | 7/1987 | Drake et al. | 156/234 |
| 4,774,530 | 9/1988 | Hawkins | 346/140 R |
| 4,789,425 | 12/1988 | Drake et al. | 156/644 |
| 4,944,836 | 7/1990 | Beyer et al. | 156/645 |
| 5,057,853 | 10/1991 | Fisher | 216/27 |
| 5,131,968 | 7/1992 | Wells et al. | 156/153 |
| 5,169,472 | 12/1992 | Goebel | 156/153 |
| 5,318,652 | 6/1994 | Hocker et al. | 216/34 |
| 5,336,319 | 8/1994 | Narang et al. | 118/211 |
| 5,547,094 | 8/1996 | Bartels et al. | 216/33 |
| 5,557,308 | 9/1996 | Chandrasekaran | 347/65 |
| 5,582,678 | 12/1996 | Komuro | 216/27 |

OTHER PUBLICATIONS

Harendt et al, "Wafer bonding for intelligent power ics: integration of vertical structures" Proceedings 1995 IEEE Intl. SOI Cong. pp. 152–153 Oct. 1995.

Article by P. Singer entitled "Chemical–Mechanical Polishing: A New Focus On Consumables", pp. 45–52, Semiconductor Intl, Feb. '94.

Article by R. Iscoff entitled "CMP Takes A Global View", pp. 72–78, Semiconductor Int'l., May '93.

Article by S. Sivaram et al. entitled "Overview of Planarization by Mechanical Polishing of Interlevel Dielectrics", pp. 606–614, ULSI Science and Technology, Electro Chemical Society, '91.

*Primary Examiner*—R. Bruce Breneman
*Assistant Examiner*—Anita Alanko

[57] ABSTRACT

An improved microelectromechanical device, such as a thermal ink jet die or printhead, is formed by the alignment of two planar substrates bonded together by an intermediate thick film layer of patterned polymeric material, such as polyimide. The improved device has a fully cured, patterned thick film layer which is planarized by chemical-mechanical polishing-to improve the bonding strength between the substrates. The planarization removes topographical formations generated during the deposition of the thick film layer and/or during the patterning of the recesses therein.

10 Claims, 6 Drawing Sheets

MICRO-ELECTROMECHANICAL DIE MODULE WITH PLANARIZED THICK FILM LAYER

BACKGROUND OF THE INVENTION

The present invention relates to micro-electromechanical die modules of the type having a planarized, patterned thick film layer sandwiched between silicon substrates, and more particularly to an improved thermal ink jet die module for use as a printhead and method of manufacture therefor, the die module eliminating the effects of standoff between two bonded parts thereof caused by topographic formations formed in a thick film insulating layer sandwiched between said two parts during deposition and patterning thereof. The ink jet die module is a specific example of a general class of micro-electromechanical die modules which combine electrical and mechanical functionality in an integrated device.

In existing thermal ink jet printing systems, an ink jet printhead expels ink droplets on demand by the selective application of a current pulse to a thermal energy generator, usually a resistor, located in capillary-filled, parallel ink channels a predetermined distance upstream from the channel nozzles or orifices. U.S. Pat. No. Re. 32,572 to Hawkins et al. exemplifies such a thermal ink jet printhead and several fabricating processes therefor. Each printhead is composed of two parts aligned and bonded together. One part is a substantially flat substrate which contains on the surface thereof a linear array of heating elements and addressing electrodes (heater plate), and the second part is a substrate having at least one recess anisotropically etched therein to serve as an ink supply reservoir when the two parts are bonded together (channel plate). A linear array of parallel grooves are also formed in the second part, so that one end of the grooves communicate with the reservoir recess and the other ends are open for use as ink droplet expelling nozzles. Many printheads can be made simultaneously by producing a plurality of sets of heating element arrays with their addressing elements on a silicon wafer and by mating a second silicon wafer having a corresponding plurality of sets of channel grooves and associated manifolds therein. After the two wafers are aligned and bonded together, the mated wafers are diced into many separate printheads.

Improvements to such two-part, thermal ink jet printheads include U.S. Pat. No. 4,638,337 to Torpey et al., that discloses an improved printhead similar to that of Hawkins et al., but has each of its heating elements located in a recess (termed heater pit). The recess walls containing the heating elements prevent lateral movement of the bubbles through the nozzle and, therefore, the sudden release of vaporized ink to the atmosphere, known as blow-out, which causes ingestion of air and interrupts the printhead operation. In this patent, a thick film insulative layer such as polyimide, Riston® or Vacrel® is formed on the wafer containing the heating elements and patterned to provide the recesses for the heating elements, so that the thick film layer is interposed between the two wafers when they are mated together. U.S. Pat. No. 4,774,530 to Hawkins further refines the two-part printhead by disclosing an improvement over the patent to Torpey et al. In this patent, further recesses (termed bypass pits) are patterned in the thick film layer to provide a flow path for the ink from the manifold to the channels by enabling the ink to flow around the closed ends of the channels, thereby eliminating the fabrication steps required to open the groove closed ends to the manifold recess. The heater plates, having the aforementioned improvements of heater pits and bypass pits formed in the thick film insulative layer covering the heater plate surface, are aligned with and bonded to the channel plate, so that each channel groove has a recessed heating element therein and a bypass pit to provide an ink passage from the ink manifold to the channel groove.

Thorough bonding between heater and channel plates is paramount to maintaining the printing efficiency, droplet size consistency, and operational reliability of an ink jet printhead. U.S. Pat. No. 4,678,529 to Drake et al. discloses a method of bonding ink jet printhead components together by spin coating or spraying a relatively thin, uniform layer of adhesive on a flexible substrate and then manually placing the flexible substrate surface with the adhesive layer against the channel wafer surface having the etched sets of channel grooves and associated manifolds or reservoirs. A uniform pressure and temperature is applied to ensure adhesive contact with all coplanar surface portions and then the flexible substrate peeled away, leaving a uniformly thin coating on the channel wafer surface to be bonded to the heater wafer. A more mechanized process to place the adhesive coating on the channel wafer without manual operator involvement and consequent variation in the amount of adhesive layer transferred to the channel wafers, especially in the thickness variations from wafer-to-wafer, is described in U.S. Pat. No. 5,336,319, to Narang et al. The prior art process for bonding die modules may work well at 300 dpi, but as printhead resolution increases, a number of problems arise.

Although advances have improved the thickness uniformity of the adhesive layer which bonds the ink jet printhead heater and channel plates, insufficient adhesion between bonded heater and channel plates causes a host of problems affecting high resolution printhead operation, such as, for example, different drop sizes between adjacent channels, because unwanted protruding topographical formations or lips are formed in the thick film layer during the patterning and curing of the heater pits and bypass pits. These topographical formations prevent adequate contact between the channel wafer surface with the adhesive layer and the thick film layer on the heater wafer. Since increased adhesive layer thickness is not a practical solution because it tends to spread or wick into the channels, the inter-channel gaps between bonded heater and channel plates should be eliminated in order to insure consistent printhead firing characteristics. As taught by the above identified U.S. patents, two wafers are bonded together after alignment for subsequent dicing into individual printheads. Each printhead part is formed individually on two separate substrates or wafers, where one contains heating elements and the other ink channels or passageways. The wafer containing the ink channels is silicon, and the channels are formed by an anisotropic etching process. The anisotropic or orientation dependent etching has been shown to be a high yielding process that produces very planar and highly precise channel plates. The other wafer containing the heating elements as well as heater addressing logic is covered by a thick film insulating layer in which heater and bypass pits are formed using photolithography. The thick film-layer is preferably polyimide, because it can be patterned in the geometries required, can withstand the temperature cycling of the heater, and is chemically resistant to the ink. However, one drawback with the polyimide material is its tendency to form unwanted topographical formations, such as raised edges or lips (1–8 microns high) at photoimaged edges. When bonding both heater and channel plates together, a standoff between the two plates is caused by the raised edges, which reduces the adhesiveness of the bond between the two plates and which cause the formation of inter-channel gaps.

In roofshooter type thermal ink jet printheads, such as disclosed in U.S. Pat. No. 4,789,425 to Drake et al., each printhead is composed of parts aligned and bonded together. One part is a substantially flat substrate which contains on the surface thereof a linear array of heating elements and addressing electrodes (heater plate). This part has a thick film insulative material deposited on the surface with the heating elements and addressing electrodes, and the thick film layer is photolithographically patterned to form ink flow paths, each containing a one of the heating elements, from an ink inlet. This inlet is usually provided through the flat substrate or heater plate to the heating elements. This patterned thick film layer is usually referred to as a "barrier layer". The final part is a nozzle plate containing an array of nozzles. The nozzle plate is aligned and bonded to the patterned barrier layer, so that each nozzle is aligned directly over one of the heating elements for droplet ejection through the nozzles in a direction perpendicular to the heating element. Thus, the roofshooter type thermal ink jet printhead is also concerned with topographic formation in the surface of the patterned barrier layer which would prevent adequate bonding of the nozzle plate thereto.

Polyimide topography, such as raised edges or lips, are undesirable byproducts resulting from photoimaged and cured heater pits and bypass pits or trenches on heater plates. The raised edges are polyimide topographical features that are formed at the edge of photoimaged areas that do not shrink during curing as would the generally non-patterned larger areas of the polyimide. Consequently, raised edges critically interfere with both the mating and bonding of the heater and channel plates of edge shooter type printheads and the mating and bonding of the heater and nozzle plates of the roofshooter printheads.

Another form of polyimide topography is encountered in the form of edge beads or raised areas at the edge of the wafer, when a layer of liquid polyimide is dispensed and spun onto a wafer. When the contact area on the wafer is incapable of spreading further due to the contact angle at the edge of the wafer, centripetal forces push the spinning liquid polyimide towards the outside of the wafer to form an edge bead. The edge bead on a 4 inch diameter wafer, for example, is on the order of 3 mm–15 mm wide radially from the outer edge thereof. Because the wafers generally have chordal portions removed (called "flats") to provide straight edges for subsequent use in identifying wafer type, crystal plane orientation, as well as for alignment features in assembly or fabrication jigs, the periphery of the wafers is not completely circular. Thus, the thickness of the edge bead varies from a few micrometers thicker than the rest of the polyimide layer to twice as thick as the majority center portion. Due to the asymmetry of the periphery of the wafer caused by the flats, the thickness of the edge bead varies substantially around the edge of each wafer. Such edge beads of polyimide prevent adequate bonding between the wafers. Edge beads can also cause a reduction in yield, because the additional stress placed on the center area of the channel plate during heater and channel plated bonding may cause cracking. Edge beads, if removed from the edge of the heater wafers, cantilevers the channel plate at its outside edges and can again cause cracks to be formed in the outer peripheral area of the channel wafer. Such cracking in the channel wafer will degrade the reliability of the individual printheads after they have separated from the wafer pair.

Raised edges and edge beads, however, are not the only topographical formation created from photoimaged polyimide. Other topographical formations, such as wall sags or dips, compound the negative effects of raised edges by adding to the standoff between the bonded heater and channel plates. Wall dips are slumps in the polyimide walls between closely adjacent polyimide photoimaged pits. The polyimide layer sandwiched between the two wafers generally has a thickness of 10 to 40 μm (cured) and can form more than 2 microns of topographical variation. The bonding adhesive is approximately 2 microns or less thick which does not allow the adhesive to bridge or fill in the formation of inter-channel gaps caused by the topographic formations. These inter-channel gaps can allow crosstalk between channels when drops are being ejected. As the patent '529 to Drake et al. teaches, care must be taken when applying adhesive in bonding the channel and heater plates so as to insure all surfaces in contact with the ink are free of adhesive, in order that the ink channels are not obstructed during operation.

A final cause of polyimide surface topography results from the presence of topography associated with the microelectronic device fabrication prior to spin casting the polyimide. Spin casting tends to cause the polyimide to conform and replicate features present on the wafer's surface. Since the surface contains features up to 4 μm thick, the polyimide surface varies by a similar amount. It is important to point out that even if no polyimide was present, it would still be difficult to completely bond a channel wafer to a heater wafer. In this content it is desirable to add an intermediate polyimide layer, if its surface can subsequently be planarized, after first being patterned to expose critical device structures. In the more general case of microelectromechanical die modules, the polyimide layer or other suitable organic layer can be added solely for this purpose.

One method of minimizing heater and channel plate standoff of printheads using a modified printhead fabrication sequence is disclosed in U.S. patent application Ser. No. 07/997,473, entitled "Ink Jet Printhead Having Compensation For Topographical Formations Developed During Fabrication", assigned to the same assignee as the present invention and filed on Dec. 28, 1992 now U.S. Pat. No. 5,412,412. The printhead enables better bonding of the two plates by compensating for raised lips or edges formed on the outside edge of opposing last pits in an array of pits located in the thick film layer that are created while photofabricating the pits in the insulating layer. The fabrication sequence compensates for the raised edges by including a non-functional straddling channel that nullifies the standoff created by the raised edge and a corresponding additional non-functional pit that positions the raised edge away from the functional channels and nozzles. Although this fabrication technique compensates for polyimide raised edges, it does not attempt to solve the problem of edge bead or dips between channels.

Another method of minimizing heater and channel plate standoff in ink jet printheads is disclosed in U.S. patent application Ser. No. 08/126,962, entitled "Ink Jet Printhead Which Avoids Effects of Unwanted Formations Developed During Fabrication", filed Sep. 27, 1993 now U.S. Pat. No. 5,450,108 and also assigned to the same assignee as the present invention. The minimization of standoff is obtained by sequentially patterning each layer of a two layer thick film layer. The relative thickness and geometrical shapes of the recesses in the two layers are selected, so that topographic formations are varied to prevent standoff between bonded heater and channel plates, thereby insuring that the adhesive applied between the bonded plates will have the greatest propensity to bond.

An article by P. Singer entitled "Chemical-Mechanical Polishing: A New Focus on Consumables," pages 48–52,

*Semiconductor International*, February 1994, discloses planarization of integrated circuit devices on silicon wafers to less than 1 μm by a process known as chemical-mechanical polishing. This process is not well understood, so that commercial production is difficult, when good planarity across the wafer, uniformity between wafers, and reliability is demanded, together with enough process latitude to prevent the polishing costs from being prohibitive. In a typical chemical-mechanical polishing process, the wafer is mounted on a rotatable carrier or chuck which is rotated and held down on a rotating polishing pad coated with a polishing slurry. The slurry typically consists of fumed silicon particles in an alkaline medium such as potassium or ammonium hydroxide. The polishing pad is generally made of cast or sliced polyurethane with a filler of urethane coated polyester felt. Pores in the pad surface aid in slurry transport, and the polymeric foam cell walls of the pad, in combination with the slurry particles, remove the reaction products from the wafer surface. Glazing of the pad's surface is thought to be the reason for the pad's drop in efficiency and removal rate over time. This means the pad surface must be reconditioned after every run by abrading its surface with, for example, a diamond wheel, thereby regenerating the surface rather than removing material from the pad.

The primary focus for chemical-mechanical polishing is to planarize continuous surfaces such as oxide passivation layers and continuous surfaces containing both oxides and metals. In contrast, the present invention is concerned with obtaining a planarized polyimide layer which has a discontinuous surface; i.e., one having recesses therein.

Article by R. Iscoff entitled "CMP Takes A Global View", pages 72–78, *Semiconductor International*, May 1993, discloses chemical-mechanical polishing (CMP) as the only viable means of globally planarizing patterned wafers with smaller than 0.35 μm features. Because the technology is relatively young, the major equipment makers have not yet recognized CMP as a large market. The slurries for CMP offer much higher purity than older formulas which have been tailored for optical performance. Generally, though, it is not the slurries but the pads which are of most concern. They must be abrasive enough to planarize efficiently, but not too abrasive or they will damage circuits.

Article by S. Sivaram et al. entitled "Overview of Planarization by Mechanical Polishing of Interlevel Dielectrics", pages 606–614, ULSI *Science and Technology*, Electrochemical Society, 1991, discloses the need for extreme planarity in fine featured devices, and discloses that chemical-mechanical polishing is needed to obtain global planarity. Concepts behind material removal are extended to the polishing process and the chemistry of glass polishing is presented. The state of the art in the polishing technology is surveyed and the areas which need improvement are highlighted, so that the chemical-mechanical polishing process can be used in volume manufacturing.

Japanese Laid-Open No. 3-268392 (Kokai), published Nov. 29, 1991, discloses a manufacturing method for a multilayer interconnection or wiring board. A first wiring pattern is formed on an insulating substrate, together with cylindrical electroconductive columns connected thereto. The first wiring pattern and electroconductive columns are covered by an insulating layer. The surface of insulating layer is polished to planarize the insulating layer surface and to expose the electroconductive columns by a scanning polishing jig which has a polishing area smaller than 30% of the area of the wiring pattern. A second wiring pattern is formed on the flat insulating layer surface and connected to the exposed electroconductive columns.

U.S. Pat. No. 4,944,836 to Beyer et al. discloses a method for producing coplanar metal/insulator films on a substrate by chemical-mechanical polishing. In one example, a substrate having an insulating layer of dielectric material thereon is patterned to produce recesses therein and then the patterned insulating layer is coated with a layer of metal. The substrate is placed in a polisher and the metal is removed everywhere except in the recesses. This is made possible by the use of a selective slurry which removes the metal much faster than the dielectric material, thereby producing a continuous coplanar surface of metal and insulating material. In a second example, a substrate having a patterned metallic layer is coated with an insulating layer and then subjected to chemical-mechanical polishing. With an appropriate change in the slurry, the structure is coplanarized by the chemical-mechanical removal of the insulating material at a significantly higher rate than the underlying metal to be exposed at the termination of the polishing. The polishing pad is firm enough so that it does not deform under the polishing load. Thus, during the initial planarization action, the high points of the structure are removed at a faster rate than from the lower points.

There continues to exist, therefore, a need to prevent the standoff between either mated heater and channel plates or mated heater substrates with patterned barrier layers and nozzle plates caused by raised lips, wall sags or dips, and/or edge beads. Such standoff prevention is desired without requiring extra non-functional, straddling channels or in drastically altering the fabrication sequence of the heater and channel plates, as disclosed in the above-mentioned prior art.

SUMMARY OF THE INVENTION

It is an object of the present invention to provide an improved micro-electromechanical device having two silicon substrates bonded together by an intermediate thick film layer of patterned polymeric material, such as, for example, polyimide, wherein the improvement is achieved by planarizing one surface of the thick film, thereby preventing topographical formations deleterious to bonding strength between the substrates.

It is another object of the invention to substantially prevent the standoff between two bonded substrates of a micro-electromechanical device, such as an ink jet printhead, wherein the two bonded substrates are the heater plate and channel plate of the printhead with a patterned thick film layer sandwiched between, and standoff of the channel plate is prevented by the planarization of the patterned thick film layer using a method having minimal impact to the existing fabrication sequence of the printhead.

In the present invention, improved devices having micro-electromechanical systems (MEMS) are disclosed. Such MEMS devices generally have two silicon wafers or substrates bonded together by an intermediate, patterned thick film polymeric layer, such as, for example, polyimide. The patterned features in the thick film layer provide cavities for the housing of electrical and electromechanical devices, such as, pressure sensors, accelerometers, and the like and including liquid flow structures and passageways that are hermetically sealed between the two silicon wafers. Planarizing the thick film layer to remove protruding topographic formations caused, for example, by the patterning process results in a stronger bond between the wafers, as well as better seals between the wafers and the thick film layer with the patterned recesses. One example of a MEMS device is an ink jet die module which may be either an "edge shooter" or "roof shooter" type thermal ink jet printhead. In a roof shooter type printhead, the heater plate has an array of heating elements with addressing electrodes and an opening therethrough for use as an ink inlet. A barrier layer of photopatternable material is deposited over the heating elements and addressing electrodes and then patterned to define liquid (ink) flow directing passageways. Each passageway contains a heating element and is in communication with the ink inlet. A nozzle plate containing an array of nozzles or orifice is aligned and bonded to the patterned barrier layer, so that one nozzle is positioned directly over a heating element for droplet ejection therethrough in a direction perpendicular to the heating element. In edge shooter type printheads, a heater plate has an array of heating elements and addressing electrodes on one surface thereof, and a thick film layer is deposited over this surface and the heating elements. The thick film layer is patterned to expose the heating elements in pits and provide bypass pits for the passageway of ink. A channel plate is etched to form, in one surface thereof, an array of parallel channels having open ends for nozzles and closed ends adjacent an ink reservoir with an ink inlet. The channel plate is aligned and bonded to the patterned thick film layer. Each channel has at least one heating element located a predetermined distance from the channel open ends or nozzles, which are located along one edge, generally referenced to as a nozzle face. Droplets of ink are ejected through the nozzles in a direction parallel to the surface of the heating elements.

The patterning of the thick film layer of a MEMS device causes protruding topographic formations such as raised lips or sagging walls referred to as dips. When the thick film layer is applied to one of the substrates of the die module (e.g., a heater plate or heater wafer) by spin coating, an edge bead is formed at the periphery of the substrate. If the substrate does not have a circular shape, for example, a wafer with flats (removed chordal sections) for subsequent in identifying wafer type, crystal plane orientation, and use as alignment edges, the edge bead will vary in thickness around the periphery. These topographic formations are detrimental to all micro-electromechanical systems (MEMS). Ordinary polishing techniques could not planarize a substrate with a thick film layer containing patterned recesses or having protruding or slumping topographic formations with height dimensions varying from the non-patterned majority portion of the thick film layer, surface by more than a few micrometers. Thus, the present invention is a MEMS device having a planarized intermediate patterned thick film layer and-method of achieving the planarization.

When the invention is described in terms of an ink jet die module, and more specifically in terms of a die module having an edge shooter configuration, the heater and channel wafer standoff by topographic formations is eliminated by planarization of the polyimide layer by a predetermined chemical-mechanical polishing process after it is patterned and cured and prior to its alignment and bonding to the channel wafer. Because the curing of the polyimide increases the topographic variation, prior art printheads used only partially cured polyimide which was not as robust and resistant to attack by a wider range of inks as a fully cured polyimide.

The method of fabricating an edge shooter type ink jet printhead having a substrate, such as a silicon wafer, containing a plurality of heating elements and driver circuitry on one surface thereof which are covered by a thick film insulative layer having recesses patterned therein, comprises the following steps:

First, the formation and passivation of a plurality of heating elements and associated driver circuitry on a planar surface of said substrate.

Second, the deposition of a thick film insulative layer, such as polyimide, on the substrate planar surface and over the heating elements and passivated driver circuitry thereon. The thick film can be deposited by spin coating from the liquid state or lamination from the solid state.

Third, the thick film layer of polyimide is patterned and cured to provide a predetermined number of recesses with substantially vertical walls at predetermined locations in the outer surface of the thick film layer. The recess walls intersect the thick film outer surface to define an edge around each recess, where unwanted topographic formations are formed.

Finally, a chemical-mechanical polishing process is performed on the outer surface of the patterned thick film layer to remove the topographic formations and thereby planarize the thick film outer surface without rounding off the recess edges, so that the raised ridges and other unwanted topographic formations are removed at a faster rate than the remainder of the outer surface of the thick film layer.

A more complete understanding of the present invention can be obtained by considering the following detailed description in conjunction with the accompanying drawings, wherein like index numerals indicate like parts.

DESCRIPTION OF THE PREFERRED EMBODIMENT

The present invention is described using an ink jet die module or printhead as a typical MEMS device. An edge shooter configuration for the die module has been arbitrarily selected, but the planarization of the ink flow directing barrier layer of a roof shooter type die module is achieved in the same way.

Figure 1:
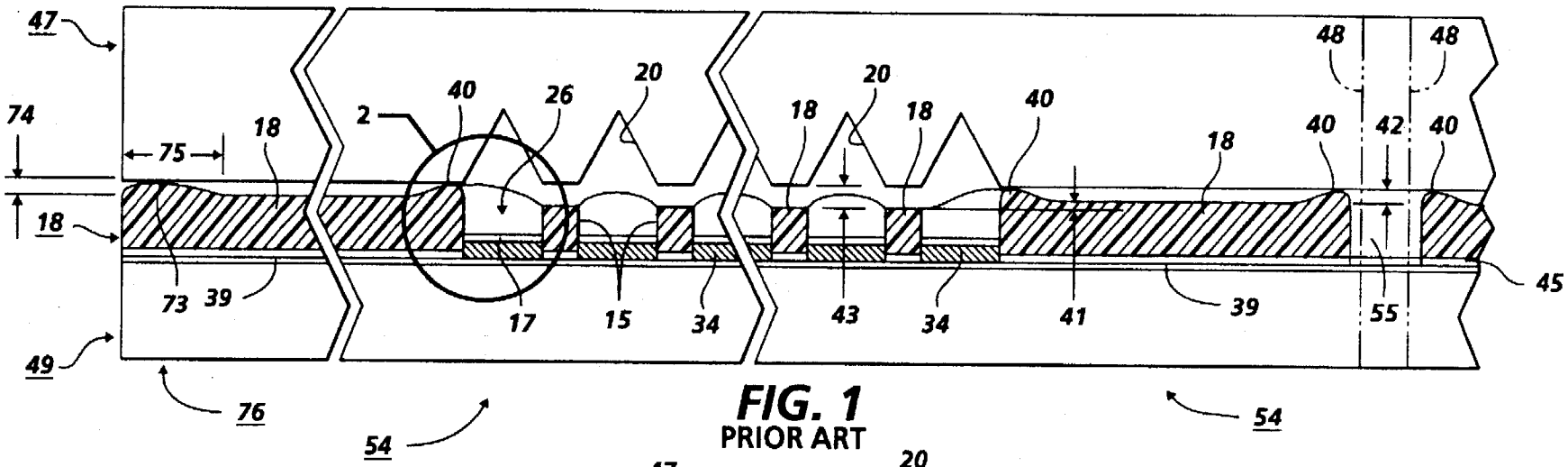
FIG. 1 PRIOR ART
FIG. 1 is an enlarged cross-sectional view of a portion of a typical prior art bonded channel wafer and heater plates.
Figure 2:
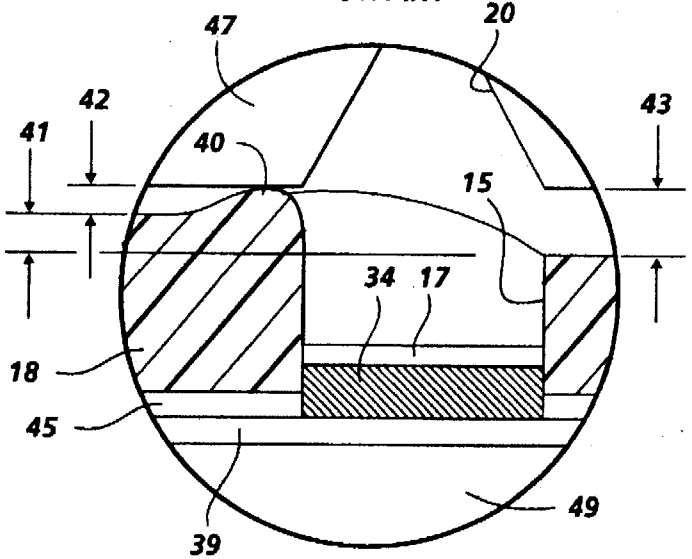
FIG. 2 PRIOR ART
FIG. 2 is an enlarged view of the area identified in FIG. 1 by circle 2.
Figure 3:
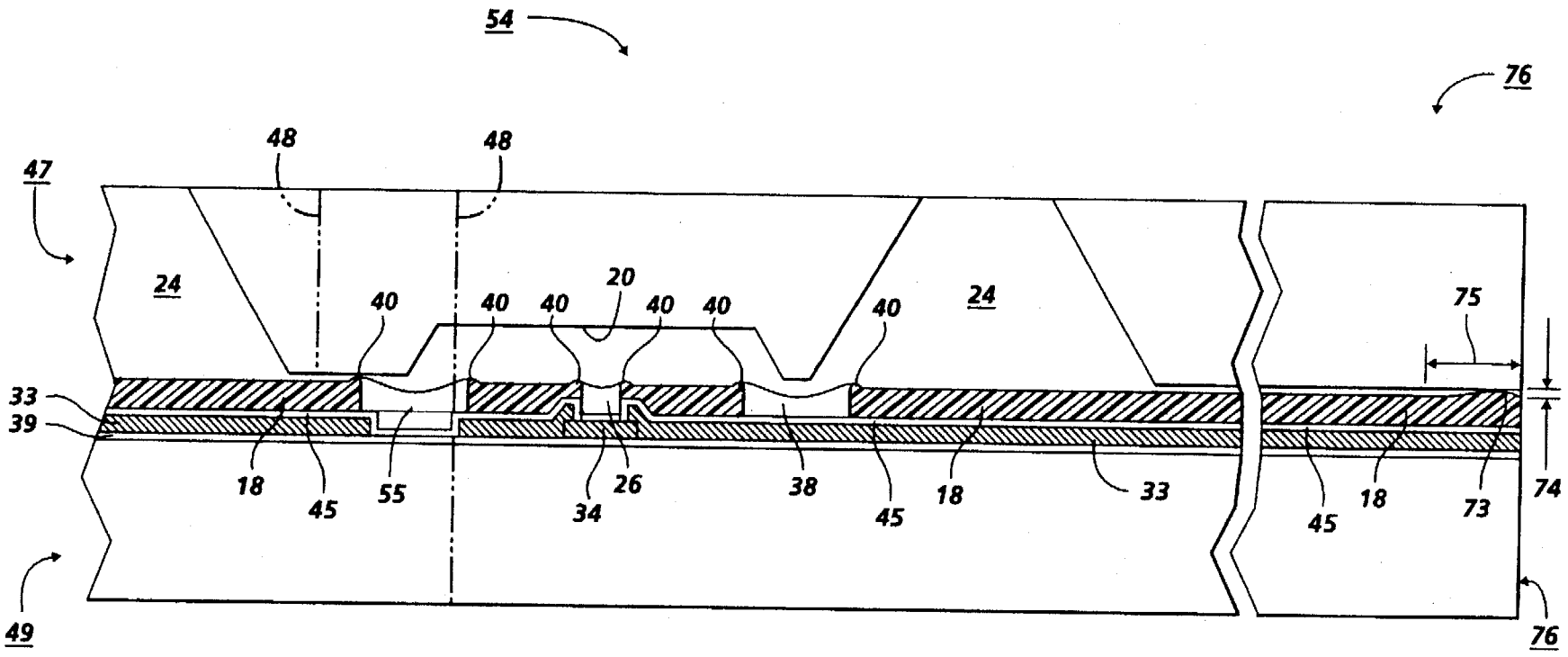
FIG. 3 PRIOR ART
FIG. 3 is an enlarged cross-sectional view of a portion of a typical prior art bonded wafer pair.

Referring to prior art FIGS. 1–3, where FIG. 1 shows a cross-sectional view of wafer pair 54 with the cross-section being perpendicular to the channels 20, and FIG. 3 shows a cross-sectional view of the wafer pair with the cross-section being taken parallel to and through one of the channels 20. FIG. 2 is an enlarged view of the area circled in FIG. 1 identified by circle 2. As is well known in the art, a thick film layer 18 of photopatternable material, such as polyimide, is deposited over the surface of a silicon substrate or wafer 49 having a plurality of linear arrays of heating elements 34 with protective layer 17, usually tantalum, and driver/logic circuitry (not shown) for each heating element array formed on an underglaze layer 39, such as silicon nitride or silicon dioxide, which thermally isolates the heating elements from the silicon wafer. The circuitry, including electrodes 33, (FIG. 3), is passivated by a layer 45 of silicon nitride or CVD silicon dioxide prior to the deposition of the polyimide. Topographic formations 40, 41, as discussed in the background, are formed when heater pits 26 are photolithographically processed in a thick film insulating layer 18, such as polyimide, on heater wafer 49. These formations on the outer opposing pits in the array have the negative quality of increasing the standoff between channel wafer 47 and heater wafer 49. One topographic formation formed while curing the photoimaged polyimide is raised edge or lip 40 which attributes to heater and channel plate standoff as indicated by spacing 42 in FIG. 2. Raised edge 40 is formed in polyimide thick film layer 18 on the outer sides of the outer heater pits 26 and outer sides of the bypass pits 38, (see FIG. 3), as well as in the front and back of each of the heater and bypass pits. Lips 40 are formed on any edge of a large area of polyimide, such as for recesses 55 formed for die cuts 48 shown in FIGS. 1 and 3. The channel plate standoff caused by the lips formed to the front and back of the pits has less effect because the channels 20 and reservoirs 24 straddle them, but the lips on the sides of pits 26 and recesses 55 produce the substantial separation or standoff. A second topographic formation is a sag or dip in wall 15 between the pits as indicated by spacing 41 in FIGS. 1 and 2. Sag is caused by the narrow width of polyimide between recesses, such as that formed between the closely spaced heater pits and bypass pits. The combination of the two resulting topographical formations of raised lips and wall sag cause a spacing or gap 43 equal to both the sag spacing 41 and the raised lip spacing 42 in the vicinity of walls 15. Walls 15 represent the separation between heater pits and between bypass recesses. This large gap 43 is responsible for promoting inter-channel cross talk or ink flow between channels that undermines the operational consistency of a printhead.

A third topographic formation is edge bead 73. This topographic formation is not a function of the photopatterning process for polyimides, but rather a function of centripetal forces incurred while spin forming the fluid polyimide layer 18 on the heater wafer 49. At the edge portion 76 of wafer 49, the edge bead 73 is held on the wafer by surface tension. The polyimide is applied to the wafer 49 as a viscous liquid and spun to cover the wafer. The width and height of the edge bead is determined by the spin parameters, shape of the wafer (flats and locations), and thickness of the film. Typically, on a 100 mm wafer with a 32 micron cured film, the width of the edge bead 73 is on the order of 3 mm, as indicated by the distance 75, and the thickness of the edge bead is about 32 μm in some locations as indicated by the dimension 74. When chordal portions of a circular wafer, such as wafer 49, are removed to form straight edge flats (not shown), the periphery of the wafer is no longer circular, so that the edge bead 73 formed varies in thickness, compounding the problem of planarization. The flats are necessary for identification of wafer type, location of crystal planes, and for use in assembly operation for alignment purposes.

In summary, the patterning or etching of recesses in a single polyimide layer such as, for example, heater and bypass pits of FIGS. 1–3, cause raised lips or edges at the edges of the recesses, whenever the recess edge was adjacent a relatively large area of unpatterned polyimide layer. On the other hand, when adjacent pits were relatively close together and the wall of polyimide material separating the pits or recesses was relatively thin, the polyimide wall would sag. Thus, the walls of polyimide between the heater and bypass pits would generally sag, while the upstream and downstream edges of the pits relative to the subsequent nozzle location would develop raised lips. Also, the outer edges of the outer pits in each array of heater and bypass pits developed raised lips. These raised lips and sagging walls resulted in a standoff or separation between the channel and heater wafers, which prevented satisfactory bonding thereof. The pits 26 for the outer heating element in each array and the outer bypass pit 38 have raised edges of 1 to 8 μm, when the polyimide is in the 35 to 50 μm thickness range, the minimum thickness required for the prevention of lateral movement of the droplet ejecting bubbles for printing at 300 spots per inch (spi). The upstream and downstream ends of the prior art pits relative to the subsequent nozzle location also have raised edges, but these raised edges generally do not interfere with bonding of the channel and heater wafers because the channels straddle the heater pits and the raised edges on the downstream ends of the bypass pits. The other ends of the bypass pits are in the large reservoir recess 24 with the open bottom 25 for ink inlet. As mentioned above, the polyimide layer 18 is spin coated over the heating element arrays and their associated driver/logic circuitry.

As disclosed in U.S. Pat. No. Re. 32,572 to Hawkins et al., U.S. Pat. No. 5,010,355 to Hawkins et al., and U.S. Pat. No. 4,774,530 to Hawkins, all of which are incorporated herein by reference, thermal ink jet die or printheads 10 (FIG. 6) of the present invention are generated in batches by aligning and adhesively bonding an anisotropically etched channel wafer 47 to a heater wafer 49 (FIG. 4) followed by a dicing step to separate the bonded wafers into individual printheads 10. Prior to forming the arrays of heating elements 34, driver circuitry 36, and addressing electrodes 33 on one surface of the heater wafer (surface 30), an underglaze layer 39 is formed thereon, such as, silicon dioxide or silicon nitride. After the arrays of heating elements and driver circuitry are formed, a protection layer for the heating elements is formed with a layer of tantalum, electrically insulated from the heater surface with silicon nitride. Then addressing electrodes 33 are formed. Subsequently, a passivation layer 45 for the electrodes and active circuitry is deposited and patterned away from the heating elements 34 and contact pads 32 (see FIG. 6). It can consist of PSG, $Si_xN_y$, polyimide, or a composite thereof. Preferably it is 4 wt. % PSG, covered by 3–4 microns of polyimide. It provides an ion barrier to protect exposed electrodes from the ink. A protective layer 17, such as tantalum, is formed on each heating element 34 to provide additional protection from the cavitational forces generated by the growth and collapse of vaporized ink bubbles. As is well known in the industry, a layer of thick-film, polymeric, insulative material 18, such as, polyimide is spin deposited on surface 30 of the heater wafer 49 and over the passivated heating element, driver circuitry, and electrodes. The thick film has a thickness of 15 to 65 μm, which will cure to a thickness of 10 to 35 microns except for the edge bead 73, as discussed earlier with respect to FIGS. 1 and 3. A primary function of the thick film is to contain the expanding vapor bubble following pulsing of the heater to eject an ink droplet. Consequently, the thickness of the thick film layer 18 is determined by the size of the drop required. For 300 spi, the optimal thickness is about 35 microns. The polyimide layer 18 is patterned to remove the polyimide over the heating elements (forming pits 26), bypass pits 38, and recesses 55 for dicing cuts, and then cured. Fully cured polyimide is known to be much more resistant to chemical attack by more aggressive inks which have high pH and contain aggressive cosolvents. Unfortunately, fully curing of the patterned polyimide layer 18 causes the unwanted topographic formations, such as raised lips, to increase in height. Therefore, the patterned polyimide layers could not be fully cured before planarization was made practical.

Figure 7:
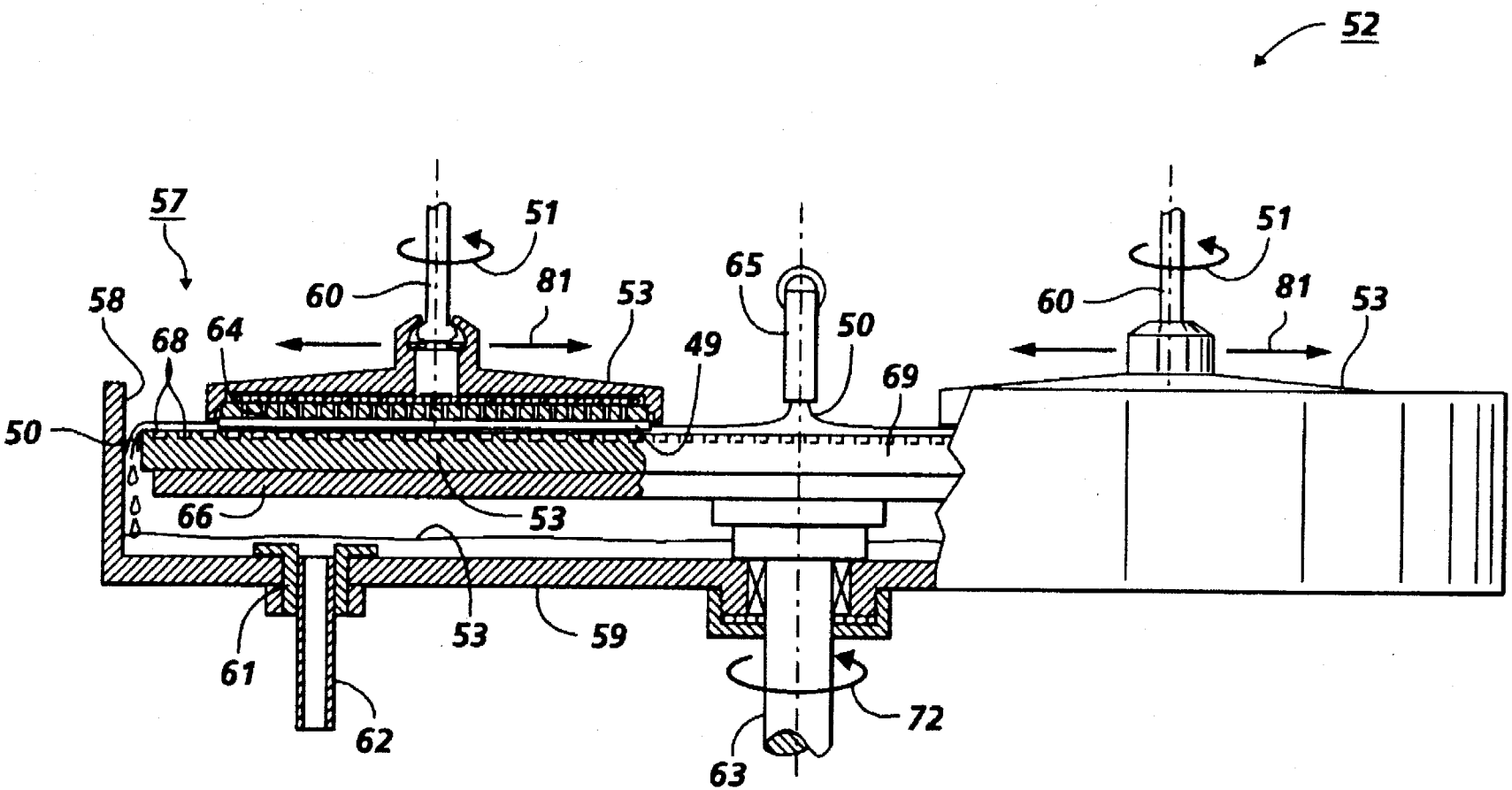
FIG. 7 is a schematically shown, partially sectioned, side elevation view of a chemical-mechanical polishing device having a rotatable vacuum chuck holding a wafer with a thick film layer to be planarized against a rotatable pad with a polishing slurry thereon.
Figure 8:
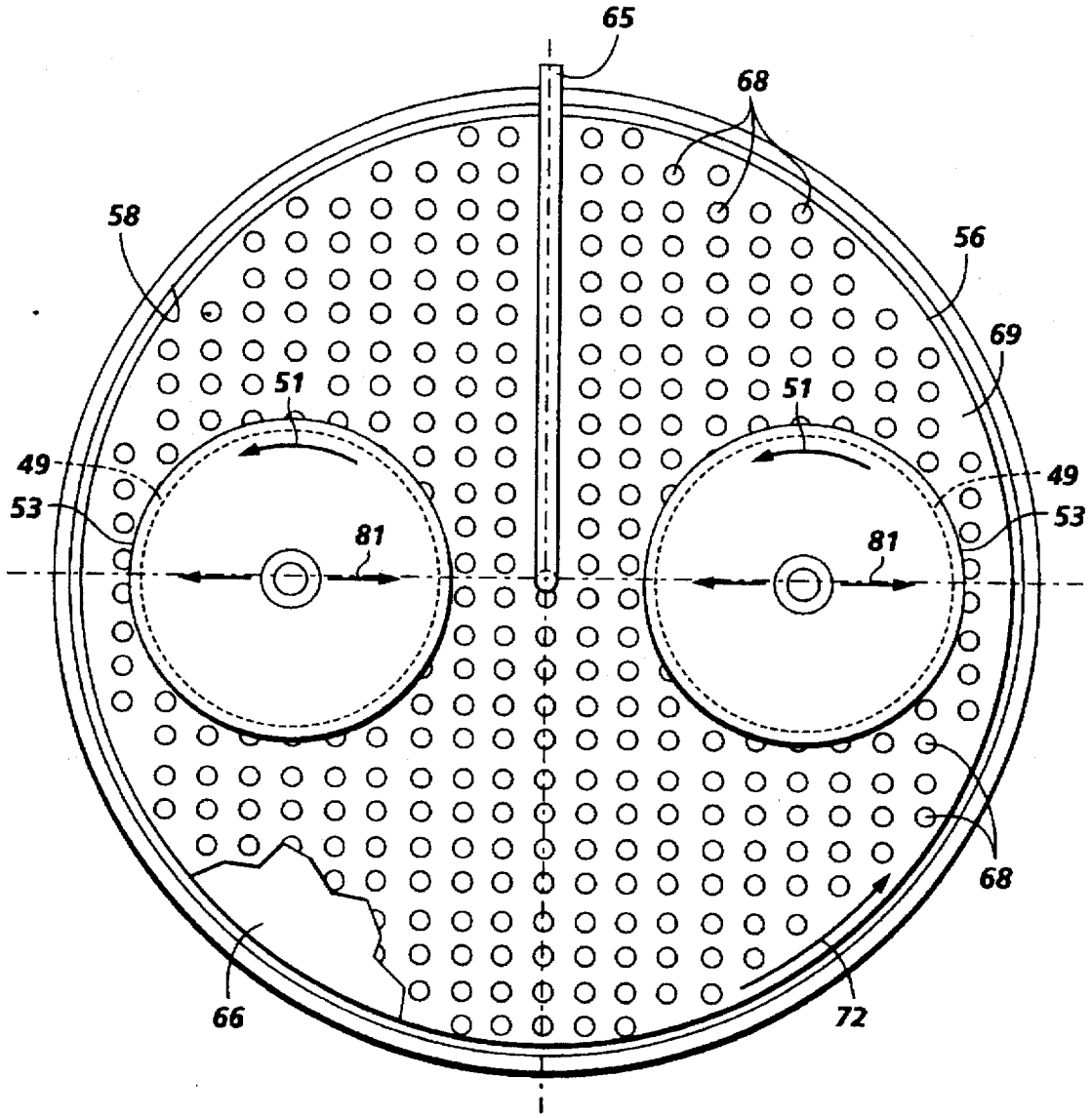
FIG. 8 is a schematic plan view of the rotatable pad and rotatable vacuum chucks of FIG. 7, showing the relative movements of the chucks and pad with the polishing slurry omitted.

After the patterned, polyimide layer 18 is cured to its final state, a heater wafer is mounted on each of the two rotatable, circular vacuum chucks 53 of a partially shown, chemical-mechanical polishing device 52, as shown in FIG. 7. The surface of the heater wafer 49, opposite the one with the polyimide layer, is gripped by a vacuum force from a vacuum pump (not shown) connected to small openings 64 in the vacuum chuck. Once the heater wafer is mounted on the vacuum chuck, the patterned polyimide layer 18 is faced downward confronting a circular polishing pad 56 mounted on a rotatable table 66 located in an open cylindrical chamber 57 formed by chamber wall 58 and chamber floor 59. A liquid polishing solution or slurry 50 is dispensed from tube 65 onto a rotatable granite polishing table 66 covered with a polishing pad 56. The slurry is dispensed through tube 65 from a slurry supply tank (not shown) onto the pad of the pad, as the pad and a table are rotated by a motor (not shown) about axis shaft 63. The polishing solution or slurry 50 is provided from the supply tank by a pump (not shown) within the chemical-mechanical polishing device. The polishing solution or slurry of aluminum oxide and aluminum nitrate is available from Rodel as R90 slurry which is diluted with water 10:1 by volume. The average aluminum oxide particle size 0.8–1.4 microns and the water soluble aluminum nitrate provides a slightly acidic slurry. The slurry is used at room temperature. The wafers are mounted in the vacuum chucks 53 and the vacuum chucks are swivelly mounted on rotatable spindles 60 in the chemical-mechanical polishing device with polyimide layer 18 face down. The spindles are lowered and the polyimide layer on the wafers brought down onto the rotating pad 56 covered granite table. The pad is coated with slurry which is dispensed from tube 65 and flows across it, with a pressure of from 0.5 to 10 psi. During polishing, in addition to the downpressure, a backpressure can be applied simultaneously with the downforce by drawing vacuum on the wafer. In the preferred embodiment, the backpressure by the vacuum shapes the wafer to be concave. The vacuum backpressure on the wafer can vary from 0–15 psi. In the preferred embodiment for polishing 300 spi patterned polyimide, the backpressure is 10 psi with a spindle applied downforce of 2 psi. For 600 spi die modules, the downforce on the heater wafer is preferably 4 psi. The table 66 can rotate between 10 and 250 RPM. The spindles can rotate between 10 and 250 RPM in a direction with, as well as opposite to, that of the table. As shown in FIG. 7, the spindles can oscillate with a stroke of 0–6 inches at a frequency from 0 to 20 cycles per minute (cpm), thus moving the polyimide layer against the slurry covered pad 56 in an oscillatory, back-and-forth direction other as indicated by arrows 81, while concurrently being rotated as indicated by arrows 51. For planarizing patterned polyimide, the preferred table speed is 100 RPM and the spindle speed is 125 RPM in the same rotary direction with a 1 inch oscillation at 6 cpm, during the planarization by the chemical-mechanical polishing procedure. The flow of the slurry is maintained across the interface between the surface of the polyimide layer and the polishing pad by the continual dispensing thereof from the tube 65, the oscillating and rotary movement of the vacuum chucks and the rotary movement of the polishing pad. A pattern of circular recesses or dimples 68 in the surface of the polishing pad also assists in maintaining a relatively uniform layer of slurry between the polyimide layer on the wafer and the polishing pad surface 69. The slurry flow rate is preferably 400 ml/min.

The raised surface of the polyimide layer in contact with the polishing pad is removed at a faster rate than the surface portions that are in contact only with the polishing solution. Uniform pressure of the polishing pad against the polyimide layer causes the polishing accomplished by the combination of polishing solution and polishing pad to remove the unwanted topographical formations (i.e., raised lips and edge bead) without wearing or rounding the edges of the heater pits and bypass pits.

Though chemical-mechanical polishing of semiconductive devices are well known for planarizing continuous surfaces comprising metal and insulative materials, the planarizing of polyimide layers without rounding off the edges of the heater pits and bypass pits, attacking the exposed aluminum and tantalum surfaces, or making the top of the surface topography non uniform over the wafer by such known processes could not be achieved. Further, the prior art surfaces that were planarized by the known chemical-mechanical polishers had surface undulations with heights of only about 1 μm, whereas the patterned polyimide surfaces of the die modules had lips, dips, and edge beads of up to 8 μm. Thus, the nagging problem of the inability to achieve high planarity between the channel wafer 47 and heater wafer 49 to ensure good bonding of the wafer pair was surprisingly eliminated by the above delineated chemical-mechanical polishing process.

While the channel wafer is extremely flat and smooth because it retains the flatness of silicon starting material, the heater wafer has uneven topography because of the patterned polyimide layer. The uneven heater wafer surface comes from both the multiple layers (field oxide, Al metal, passivation, PSG flow glass) which are used to create the circuitry and, more importantly, from curing of the final polyimide layer, which is about 35 μm thick. As described earlier with respect to FIGS. 1–3, when the polyimide is photopatterned, the edges develop "lips" or ridges following curing. Polyimide is a very rigid material after it is fully cured. The high areas prevent good sealing between the low areas of the heater wafer and the channel wafer and the resulting die module produced poor print quality. One known process which was used for die modules which printed at 300 spi was to optimize the polyimide cure cycle so that the material was not fully cured. Not fully curing the polyimide was necessary because, as polyimide becomes more fully cured, the topographic formations become more severe; i.e., the lip height grows. Therefore, the degree of cure of the polyimide layer was compromised to achieve acceptable topography. When the polishing process above is used, the patterned polyimide may be fully cured.

Careful screening of polyimide materials together with partial curing allows 300 spi die modules to be laminated without the benefits of the invention described here. At the present time, new ink formulations are being discovered which have desirable attributes such as waterfastness, increased color gamut, better print quality and other benefits. No polyimides exhibit sufficient as-processed planarity and simultaneously have resistance to high performance inks. Fully cured polyimides have increased resistance to high performance inks. In addition to enabling use of a broader range of polyimides with increased chemical stability, the planarizing process described here also enables a large number of alternative thick film materials to be used for printhead fabrication.

While the heater wafer surface topography problem is a challenge for 300 spi drop ejectors, scaling to higher resolution makes the problem successively worse for die modules printing at 400 spi and 600 spi. For these higher resolutions, it is highly desirable to make the polyimide layer thinner, so that the printhead can be scaled in all dimensions. For example, 600 spi die modules or printheads require 16 μm layers, less than half of the preferred polyimide layer for 300 spi printheads. The thinner polyimide layers have less ability to planarize the polyimide covered layers on the heater's surface. In practice, a very different approach must be applied for die modules printing at 600 spi to achieve functionality, and planarizing the patterned polyimide layer is one solution.

in addition, the spin casting of polyimide creates an edge bead 73 around the periphery of the heater wafer 49 which is nonuniform in thickness, because of the flats diced on the wafer, and can be twice as high as the central portion of the polyimide layer's surface (70 μm thick). As a consequence, application of pressure tends to crack the channel wafer even before the wafer surfaces contact each other during the mating and bonding step. One prior art process used is to chemically remove the polyimide around the edge of the wafer. Although this enables the wafers to be bonded, yield loss occurs because the heater wafer edge and the channel wafer edge extend beyond the sandwiched polyimide layer, forming cantilevered edges, and cracking occurs around the edge of the channel wafer during bonding.

The preferred solution to the heater wafer topography problem is to planarize the surface of the heater wafer after the polyimide layer is applied and patterned. However, typical polishing techniques, including known chemical-mechanical polishing, eliminated the lips, but polished the edges of the heater and bypass pits more rapidly than the bulk surface, creating dips between the heaters, made the wafers' thickness nonuniform in bulk or non-patterned areas of the polyimide layer, although they started out uniformly thick, tore off pieces of the polyimide walls between the pits, and could not completely remove the relatively large edge bead. Unlike conventional chemical-mechanical polishing, which combines chemical etching as well as abrasion, the present invention for polishing polyimide is only a mechanical process. A basic colloidal silica slurry, commonly used in CMP, produces inferior results with polyimide. The etch rate is slow and nonuniform. There is concern that exposing aluminum electrodes to this basic slurry will cause corrosion of the aluminum and interfere with wire bonding and subsequent reliability. The slurry that was found to produce satisfactory results for polyimide is a lightly acidic solution of aluminum oxide, aluminum nitrate, and water, as discussed above, and consequently no chemical etching occurs. Typical pressures for chemical-mechanical polishing, as well as conventional glass polishing processes, are at least 7 psi. When a pressure this high was used for patterned polyimide layers on heater wafers, the edge bead was not removed and the bulk non-patterned areas of polyimide becomes nonuniform. A key challenge to polishing patterned polyimide layers with an edge bead is that the edge bead thickness is nonuniform because of the wafer flats, and in some places along the edge bead, it is twice as thick as the bulk non-patterned areas. The amount of polyimide thickness to be removed from the other patterned structures is approximately an order of magnitude less. Because of the topography of the patterned polyimide layer with the nonuniform height of the edge bead, the wafer is nonparallel to the polishing table, during at least the initial polishing procedure. At conventional polishing pressures, the wafer deforms enough and bulges from the vacuum chuck to polish in the center simultaneously with polishing at the edge. Because the thickness of the edge bead is much greater than in the center, too much material is removed from the center, the edge is not planarized, and some of the edge bead remains. From this result, a low pressure, i.e. <2 psi and a hard polishing pad was tried, but the low pressures resulted in severe wall 15 damage between the pits 26. Thus, the optimal pressures were found to vary with the pattern of the polyimide film on the wafer, and in the preferred embodiment for a die module printing at 300 spi, the downward pressure was established as indicated above.

Figure 4:
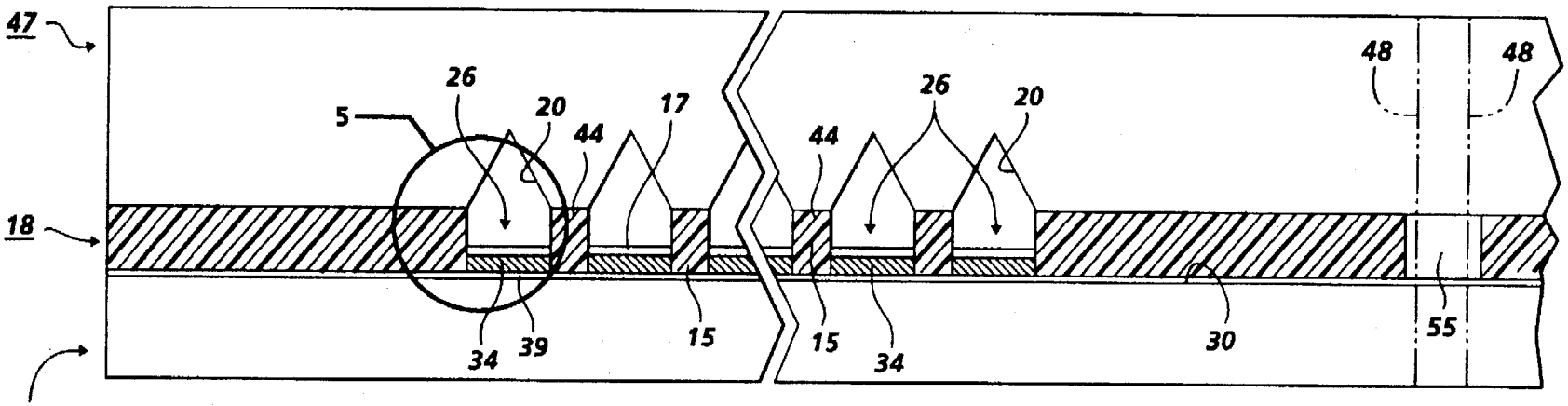
FIG. 4 is a cross-sectional front view of a portion of an aligned and adhesively bonded channel wafer and heater wafer formed in accordance with the present invention.
Figure 5:
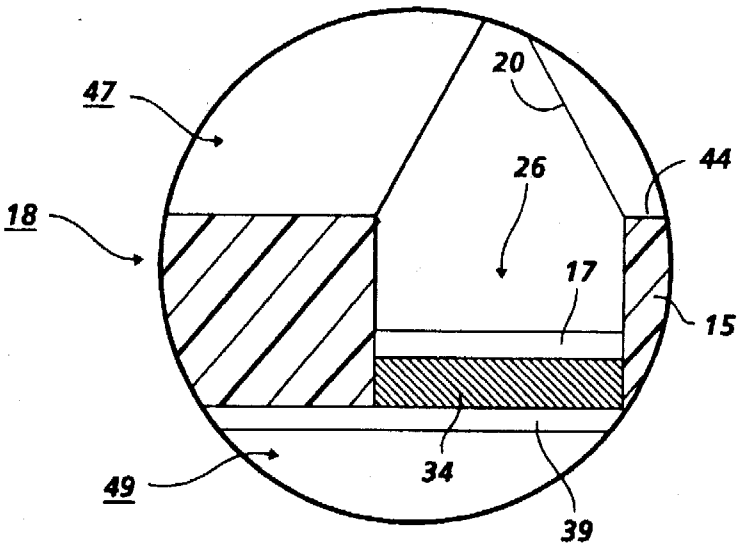
FIG. 5 is an enlarged view of the area identified in FIG. 3 by circle 5.

After planarization of the patterned, thick-film, polyimide layer 18, the channel wafer 47 and heater wafer 49 are aligned and bonded together in a manner well known in the art; i.e., as disclosed in U.S. Pat. No. 4,774,530 to Hawkins. FIG. 4 is a cross-sectional front view of a portion of an aligned and adhesively bonded channel wafer 47 and heater wafer 49 prior to separation into a plurality of individual thermal ink jet printheads 10, shown in FIG. 6. FIG. 5 is an enlarged cross-sectional view of one of the channels 20 in FIG. 4 and identified by circle 5. FIG. 5 shows the outer edge of the heater pit 26 after the planarization of the polyimide layer 18 and bonding of the two wafers. The interface between the planarized polyimide layer and the channel wafer are in full contact, the usual topographic formations of lip 40 and sag 43 having been polished away. Refer to FIG. 2 for comparison. Referring the FIG. 4, not only are the edge beads and raised lips of FIG. 1 removed by the planarization of the photopatternable, thick film layer, preferably polyimide, but enough of the polyimide layer is removed to eliminate the sag 43 in the walls 15 of polyimide between heater pits 26 and dips due to underlying topography, not planarized by the polyimide. Thus, the channel wafer surface between channels 20 and the polyimide walls 15 between heater pits 26 are in full contact (the adhesive layer not being shown for clarity), as depicted at the interface indicated by index numeral 44.

Figure 6:
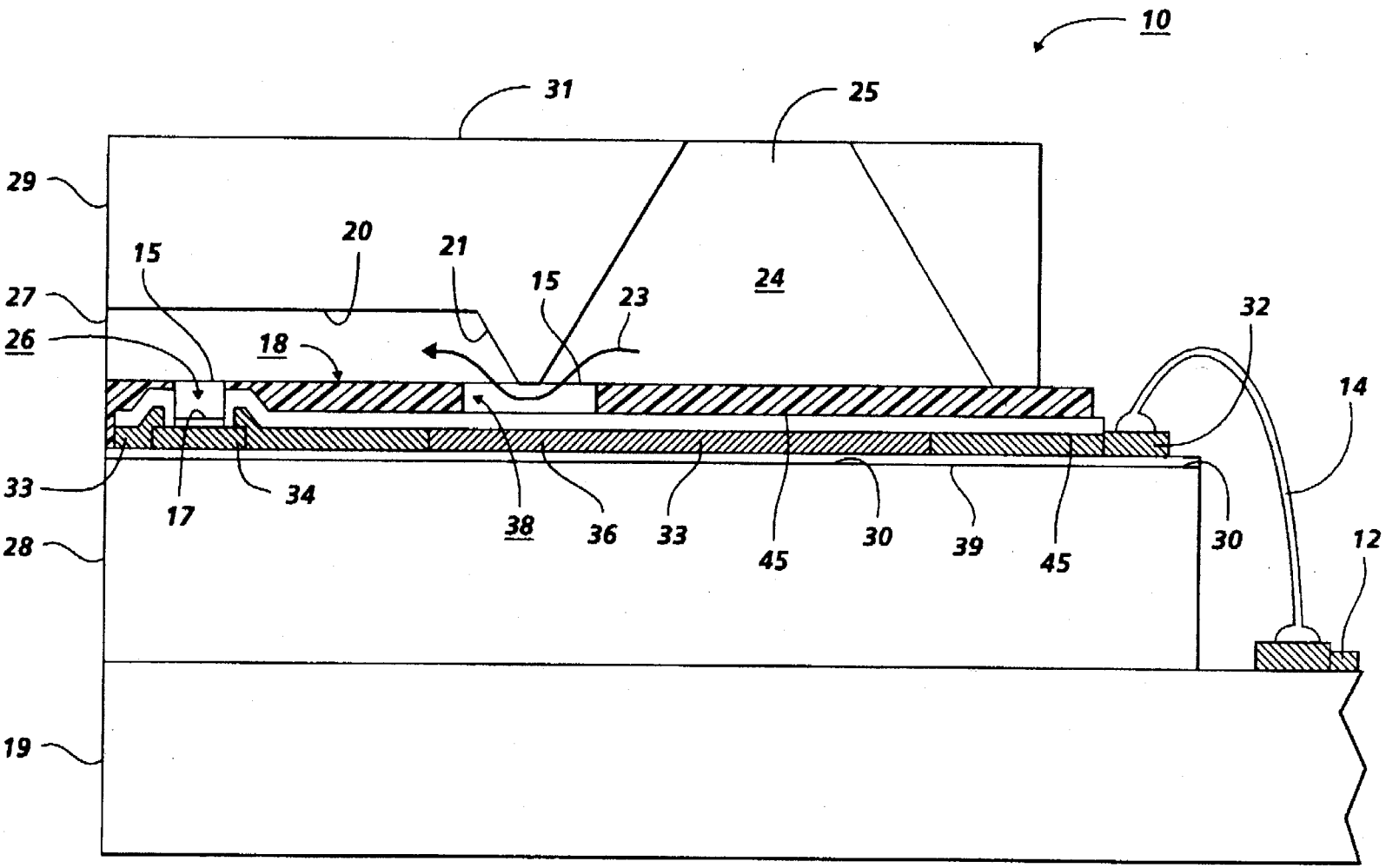
FIG. 6 is an enlarged, schematic cross-sectional view of a single printhead after being severed from the aligned and bonded wafer pair in FIG. 4.

In FIG. 6, a cross-sectional view taken along the length of the channel 20 of printhead 10, incorporating the present invention and showing the front face 29 thereof containing droplet emitting nozzles 27. Ink (not shown) flows from the manifold or reservoir 24 and around the end 21 of the groove or ink channel 20, as depicted by arrow 23. The lower electrically insulating substrate or heating element plate 28 has the heating elements or resistors 34, driver circuitry 36, and addressing elements 33 produced monolithically on underglaze insulating layer 39 formed on surface 30 thereof, while the upper substrate or channel plate 31 has parallel grooves 20 which extend in one direction and penetrate through the channel plate front face 29. The end of grooves 20 opposite the nozzles terminate at slanted wall 21. The through recess 24 is used as the ink supply manifold for the capillary filled ink channels 20 and has an open bottom 25 for use an as ink fill hole. The surface of the channel plate with the grooves are aligned and bonded to the heater plate 28, so that a respective one of the plurality of heating elements 34 is positioned in each channel 20, formed by the grooves and the lower substrate or heater plate. Ink under a slight negative pressure enters the manifold formed by the recess 24 and the lower substrate 28 through the fill hole 25 and, by capillary action, fills the channels 20 by flowing through a plurality of elongated recesses or bypass pits 38 formed in the thick film insulating layer 18, either one for each channel 20 or through a common trench-like recess that serves all of the channels. The ink at each nozzle forms a meniscus, the combination of negative ink pressure and surface tension of the meniscus prevents the ink from weeping therefrom. The heating elements are covered by protective layer 17, such as tantalum (Ta), to prevent cavitational damage to the heating elements caused by the collapsing vapor bubbles. The printheads can be mounted on daughterboards 19 and electrically connected to electrodes 12 thereon by wire bonds 14 between the daughterboard electrodes 12 and the contact pads 32 of the printhead. The daughterboard provides the interface with the printer controller (not shown) and power supplies (not shown). The patterned polyimide layer 18 provides heater pits 26 and ink flow bypass pits 38. The planarization of the patterned polyimide layer 18 eliminates the unwanted topographic formations, so that the channel plate surface between channels 20 and the polyimide walls 15 between the heater pits and bypass pits have full contact (the bonding adhesive is omitted in FIG. 6 for clarity).

Many modifications and variations are apparent from the foregoing description of the invention, and all such modifications are variations intended to be within the scope of the present invention.

We claim:

1. A method of fabricating a plurality of micro-electromechanical die modules having a patterned, polymeric thick film layer bonded between two substrates, comprising the steps of:

(a) forming a plurality of electrical circuits on a planar surface of a first substrate;

(b) passivating the electrical circuits;

(c) depositing a thick film, polymeric insulative layer on the first substrate surface and over the passivated electrical circuits, said thick film layer having an outer surface;

(d) patterning the thick film layer to provide at least one recess in the thick film layer at locations for each electrical circuit, each recess having an edge at the outer surface of the thick film layer;

(e) curing the patterned thick film layer on the first substrate;

(f) performing a chemical-mechanical polishing of the outer surface of the patterned thick film layer to planarize the outer surface of the patterned thick film layer and remove topographic formations produced by any of the previous steps; and (g) bonding a planar surface of a second substrate to the planarized outer surface of the patterned thick film layer on the first substrate.

2. The method of fabricating die modules in claim 1, wherein the method further comprises the step of:

h) dicing the bonded first and second substrate with intermediate planarized, patterned thick film layer into a plurality of individual micro-electromechanical die modules.

3. The method of fabricating die modules in claim 2, wherein the die modules are ink jet printheads.

4. The method of fabricating die modules in claim 3, wherein the electrical circuits on the planar surface of the first substrate are a plurality of arrays of heating elements with addressing electrodes.

5. The method of fabricating die modules in claim 4, wherein the patterned thick film layer is a barrier layer for directing ink to the heating elements; and wherein the second substrate is a nozzle plate containing nozzles therein, the nozzles being located directly above each heating element.

6. The method of fabricating die modules in claim 4, wherein the patterned thick film layer is polyimide; wherein said at least one recess is a pit exposing at least one heating element; wherein the second substrate is a silicon wafer containing in the planar surface thereof a plurality of sets of etched ink channels and an etched reservoir for each set of ink channels; and wherein the first and second substrates are aligned, so that at least one heating element resides in each one of the ink channels.

7. The method of fabricating die modules in claim 6, wherein the method further comprises the steps of: (i) before step (c), cutting at least one chordal portion from the first substrate to form an alignment flat at the periphery thereof; and wherein said depositing of the thick film polyimide layer at step (c) is by spin coating, the spin coating of the thick film layer of polyimide producing an edge bead at the periphery of the first substrate having a varying thickness.

8. The method of fabricating die modules in claim 7, wherein the chemical-mechanical polishing during step (f) further comprises the steps of:

(j) placing the first substrate in a rotatable vacuum chuck swivelly mounted on vertical spindles in a chemical-mechanical polishing device which may be raised and lowered, the surface of the first substrate opposite the one with the patterned polyimide layer being held in the vacuum chuck by a vacuum with the polyimide layer directed downward;

(k) providing a rotatable table with a polishing pad thereon, the polishing pad containing a plurality of recesses or dimples throughout an upper face surface thereof;

(l) directing a polishing slurry onto the center of the polishing pad;

(m) rotating the table and polishing pad to cause the slurry to be spread uniformly on the polishing pad surface;

(n) rotating and lowering the vacuum chuck until the patterned polyimide surface is in contact with the slurry covered polishing pad; and (o) oscillating the spindles so that the first substrate containing the patterned polyimide layer is moved in mutually perpendicular directions while being rotated to polish topographic formations from the polyimide layer and thereby planarize the patterned polyimide layer surface.

9. The method of fabricating die modules in claim 8, wherein the vacuum chuck has a slightly concave surface for placement of the first substrate; wherein a vacuum is used to apply a backpressure and conform the first substrate to the shape of the concave surface in the vacuum chuck, thereby enabling the polish removal of the topographic formations without removal of the non-patterned areas of the polyimide layer.

10. The method of fabricating die modules in claim 9, wherein the method further comprises the steps of:

(p) placing a downward force on the rotating vacuum chuck so that the first substrate therein is pushed against the slurry covered polishing pad with a force of about 2 psi when the polyimide layer is 35 μm thick;

wherein the vacuum applied backpressure on the first substrate is about 10 psi;

wherein the table is rotated at about 100 rpm;

wherein the vacuum chuck is rotated at about 125 rpm and in the same rotary direction as the table; and wherein the vacuum chuck is oscillated with a 1 inch displacement at a frequency of 6 cycles per minute.

* * * * *